US008465014B2

(12) United States Patent
Fuda

(10) Patent No.: US 8,465,014 B2
(45) Date of Patent: Jun. 18, 2013

(54) FEEDING DEVICE AND IMAGE FORMING APPARATUS

(75) Inventor: Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/929,467

(22) Filed: Jan. 27, 2011

(65) Prior Publication Data

US 2011/0187042 A1 Aug. 4, 2011

(30) Foreign Application Priority Data

Feb. 4, 2010 (JP) ..... 2010-023499

(51) Int. Cl.
*B65H 3/44* (2006.01)

(52) U.S. Cl.
USPC ..... 271/9.01; 271/9.11; 271/97

(58) Field of Classification Search
USPC ..... 271/9.01, 9.13, 12, 94, 97, 98, 9.11, 271/9.12; 399/391
See application file for complete search history.

(56) References Cited

U.S. PATENT DOCUMENTS

| | | | | |
|---|---|---|---|---|
| 6,543,759 | B2 * | 4/2003 | Yamaguchi et al. | 271/98 |
| 2005/0236758 | A1 * | 10/2005 | Ohgita et al. | 271/10.11 |

FOREIGN PATENT DOCUMENTS

| | | | |
|---|---|---|---|
| JP | 2934442 | A | 3/1990 |
| JP | 3559437 | A | 7/1999 |
| JP | 2000103535 | A | 4/2000 |
| JP | 2000177870 | A | 6/2000 |
| JP | 3959629 | A | 3/2004 |
| JP | 2004224505 | A | 8/2004 |
| JP | 2006016159 | A | 1/2006 |
| JP | 4495637 | A | 12/2006 |
| JP | 2007-045630 | | 2/2007 |
| JP | 4516504 | A | 2/2007 |
| JP | 2007331905 | A | 12/2007 |
| JP | 2008308303 | A | 12/2008 |
| JP | 2009057155 | A | 3/2009 |
| JP | 2009190840 | A | 8/2009 |
| JP | 2009203072 | A | 9/2009 |
| JP | 2010089955 | A | 4/2010 |

* cited by examiner

*Primary Examiner* — Michael McCullough
(74) *Attorney, Agent, or Firm* — Harness, Dickey & Pierce, P.L.C.

(57) ABSTRACT

A feeding device includes: a sheet housing unit; a sheet conveying unit having an endless belt member, which faces a topmost sheet of sheets stacked in the sheet housing unit, and a suction unit disposed inside the belt member; a sheet lifting unit that lifts the topmost sheet to a position where the topmost sheet is attracted on a surface of the belt member by a negative pressure generated by the suction unit; and an external device sheet conveying unit that conveys a sheet fed from another feeding device connected to the feeding device to a gap between the topmost sheet in the sheet housing unit and the belt member. In feeding the sheet fed from the other feeding device to the subsequent step, the sheet lifting unit is stopped while the suction unit, the belt member, and the external device sheet conveying unit are operated.

13 Claims, 12 Drawing Sheets

FEEDING DEVICE AND IMAGE FORMING APPARATUS

CROSS-REFERENCE TO RELATED APPLICATIONS

The present application claims priority to and incorporates by reference the entire contents of Japanese Patent Application No. 2010-023499 filed in Japan on Feb. 4, 2010.

BACKGROUND OF THE INVENTION

1. Field of the Invention

The present invention relates to a feeding device provided to an image forming apparatus such as a copying machine, a facsimile, and a printer. Particularly, the present invention relates to a feeding device that attracts a sheet at the top of sheets stacked in a sheet housing unit onto a belt member and feeds the sheet to a subsequent step such as an image forming section by the surface movement of the belt member, and an image forming apparatus provided with the feeding device.

2. Description of the Related Art

In a feeding device provided to an image forming apparatus and the like, it is important to accurately send out one by one among a plurality of sheets such as recording sheets stacked in a sheet housing unit and thus, a separating mechanism that separates the stacked sheets one by one is required. Generally, separating mechanisms employ a frictional separation method by which a sheet sent from a sheet housing unit by a pick-up roller is separated and fed by frictional force. Examples of the frictional separation type separating mechanisms include a combination of a separating roller and a friction pad and a combination of a separating roller and a reverse roller.

As a feeding device provided with a separating mechanism different from the frictional separation type, Japanese Patent Application Laid-open No. 2007-45630 proposes a feeding device that separates and feeds a sheet using a flow of air. The outline of the feeding device that uses the flow of air to separate and feed a sheet will be explained below.

A feeding device 200 illustrated in FIG. 16 is provided with a paper feed tray 6 that is a sheet housing unit where a plurality of sheets of paper P is stacked, which are nearly horizontal, and a suction belt 2 arranged with a suction device 40 inside the suction belt. The feeding device 200 is further provided with a blowing device 1 that blows air as indicated by the arrow A in FIG. 16 towards the vicinity of the leading edge in a conveying direction (arrow D direction in FIG. 16) of a topmost paper P1 positioned at the top of the paper P placed in the paper feed tray 6. Operating the suction device 40 generates a negative pressure to cause the flow of air as indicated by the arrow B in FIG. 16 that acts to attract the paper P on the lower outer surface of the suction belt 2.

In the feeding device 200, the blowing device 1 blows air to send the air between the sheets of paper P to lift the topmost paper P1 up to the height of the suction belt 2. The topmost paper P1 reached the height of the suction belt 2 is attracted on the lower outer surface of the suction belt 2 by the act of the negative pressure generated by the suction device 40. Thereafter, by the surface movement of the suction belt 2 as indicated by the arrow C in FIG. 16, the topmost paper P1 attracted on the suction belt 2 is conveyed towards the direction indicated by the arrow D in FIG. 16 to reach an image forming section that is a subsequent step and then, image forming is performed.

The blowing device 1 not only lifts the topmost paper P1 up to the height where it is attracted on the suction belt 2, but also separates the leading edge portion side of sheets of the paper P by sending the air between the sheets of paper P. The topmost paper P1 of the paper P with the leading edge portion being separated is attracted on the suction belt 2 and conveyed, thereby allowing the topmost paper P1 to be separated from the other paper P and only the topmost paper P1 to be fed.

The feeding device 200 is also provided with a sheet top sensor 3 that detects the height of the top surface of the topmost paper P1 for maintaining a distance h between the top surface of the topmost paper P1 of the paper P in the paper feed tray 6, which decreases in number by feeding, and the bottom surface of the suction belt 2 within a certain range. Based on a detection signal of the sheet top sensor 3, by controlling an elevating mechanism not depicted which moves a bottom plate 61 of the paper feed tray 6 up and down to adjust the height of the bottom plate 61, the feeding device 200 causes the distance h between the top surface of the topmost paper P1 of the paper P placed on the bottom plate 61 and the bottom surface of the suction belt 2 to be within the certain range.

On the downstream side in the conveying direction from the suction belt 2, a pair of carriage rollers 8 is disposed and the pair of carriage rollers 8 further conveys the paper P conveyed by the suction belt 2 reaching between the two rollers towards the downstream side. Furthermore, on the downstream side in the conveying direction from the pair of carriage rollers 8, a feed sensor 9 that detects the passing of the paper P is provided.

The feeding operation of the feeding device 200 illustrated in FIG. 16 will be explained.

When a command to start feeding is received from a control unit of an image forming apparatus body not depicted, as illustrated in FIG. 17, the blowing of the blowing device 1 and the suction of the suction device 40 are started while the suction belt 2 is being stopped. As the blowing device 1 is started to blow air, the air is blown to the leading edge portion of the paper P as indicated by the arrow A in FIG. 17 and the topmost paper P1 of the stacked paper P is lifted. By starting the suction of the suction device 40, a negative pressure is generated as indicated by the arrow B in FIG. 17 and the topmost paper P1 lifted is attracted on the suction belt 2.

After an elapse of a given time (for example, 3 seconds) from the start of the blowing by the blowing device 1 and the suction by the suction device 40, while the blowing device 1 and the suction device 40 are in operation, as indicated in FIG. 18, the drive of the suction belt 2 and the pair of carriage rollers 8 is started. The suction belt 2 receives the drive transmitted and starts the surface movement in the arrow C direction indicated in FIG. 18, resulting in the topmost paper P1 attracted on the bottom surface of the suction belt 2 being conveyed towards the downstream side in the conveying direction and reaching the pair of carriage rollers 8. The rotation of the pair of carriage rollers 8 in the arrow G direction indicated in FIG. 18 conveys the topmost paper P1 further towards the downstream side.

As depicted in FIG. 19, when the leading edge of the topmost paper P1 conveyed by the suction belt 2 and the pair of carriage rollers 8 is detected by the feed sensor 9, the drive of the suction belt 2 is stopped. When the drive of the suction belt 2 is stopped while the suction device 40 is in operation, a force to stop conveying acts on a portion of the paper P1, at which the paper P1 is attracted on the suction belt 2. However, in the feeding device 200, the respective members are arranged such that a conveying force given to the paper P1 by the pair of carriage rollers 8 is substantially greater than the force to stop conveying. Therefore, the topmost paper P1 is continued to be conveyed by the pair of carriage rollers 8 while the suction belt 2 is being stopped.

The sheet that subsequently comes to the top of the paper P after the topmost paper P1 is defined as a next topmost paper P2. As indicated in FIGS. 17 to 19, while the topmost paper P1 is attracted on the suction belt 2, the leading edge portion of the next topmost paper P2 flaps below the topmost paper P1 as it is receiving the blowing air from the blowing device 1. Accordingly, the leading edge portion side of the next topmost paper P2 is being separated from the paper P below.

Then, immediately after the trailing edge portion of the topmost paper P1 passes through the suction area of the suction device 40, as depicted in FIG. 20, by the flow of air formed between the blowing device 1 and the suction device 40, the next topmost paper P2 is lifted and attracted on the suction belt 2.

According to a predetermined feeding interval, after an elapse of a given time from the operational timing of the feed sensor 9 detecting the leading edge of the topmost paper P1 as indicated in FIG. 19, the drive of the suction belt 2 is resumed. Consequently, similarly to the topmost paper P1 depicted in FIG. 18, the next topmost paper P2 is conveyed by the suction belt 2 towards the downstream side in the conveying direction reaching the pair of carriage rollers 8, and is further conveyed towards the downstream side by the pair of carriage rollers 8.

While the blowing device 1, the suction device 40, and the pair of carriage rollers 8 are in operation, the drive of the suction belt 2 is controlled on and off. The operations depicted in FIGS. 18 to 20 are repeated, thereby sequentially feeding the paper P one by one towards the image forming section.

The feeding device that separates and feeds the sheet by using the flow of air can feed the sheets faster than the feeding device that separates and feeds the sheet by the frictional separation method. The reasons for this are as follows. In the frictional separation method, because it requires a time to frictionally separate the sheet, it has certain limitations with respect to high linear speed and high productivity. On the other hand, in the feeding device illustrated with reference to FIGS. 16 to 20, right after the previous sheet attracted on the suction belt passes through the suction area, the next sheet is separated from the further next sheet and attracted on the suction belt. Consequently, because it only needs to convey the sheet that is separated by the flow of air, it can deal with the high linear speed and high productivity.

The feeding device that separates and feeds the sheet using the flow of air has an advantage of feeding the sheet fast. This leads to the fact that a large number of sheets are consumed in a short period of time. Accordingly, with a single use of such feeding device, a user may have to replenish the sheets to the sheet housing unit in the feeding device very often.

As a structure to reduce replenishing frequency of the sheets, a feeding structure having feeding devices connected in series can be exemplified. As the structure to connect the feeding devices, Japanese Patent Application Laid-open No. 2009-57155 discloses a structure of connecting the feeding devices of the frictional separation type. In the feeding devices disclosed therein, one feeding device is arranged between an image forming apparatus body and the other feeding device and is structured to pass the sheet fed from the other feeding device through inside of the one feeding device. In the structure disclosed therein, a dedicated feed path is provided for the sheet fed from the other feeding device bypassing a sheet conveying unit that separates and feeds the sheet in the sheet housing unit of the one feeding device disposed on the image forming apparatus body side.

FIG. 21 is a diagram illustrating an example of an exemplary image forming apparatus with a feeding device disposed on the image forming apparatus side that is combined with a structure provided with a dedicated feed path for the sheet fed from other feeding device and a feeding device that separates and feeds the sheet using the flow of air.

An image forming apparatus 10 depicted in FIG. 21 is structured with a first feeding device 200*a* and a second feeding device 200*b* connected together with an image forming apparatus 10*a*. In the image forming apparatus 10, a dedicated external device sheet feed path 13 is provided so as to bypass the suction belt 2 forming the sheet conveying unit that separates and feeds the sheet from the paper feed tray 6 in the first feeding device 200*a*.

Consequently, with the structure connecting the feeding devices together, it requires a feed path dedicated for the sheet fed from the feeding device on the upstream side towards the image forming apparatus body to be provided in the feeding device on the downstream side. Providing the dedicated feed path causes an increase in component cost and an increase in space for the dedicated feed path for the feeding device on the downstream side.

SUMMARY OF THE INVENTION

It is an object of the present invention to at least partially solve the problems in the conventional technology.

According to an aspect of the present invention, there is provided a feeding device including: a sheet housing unit in which a plurality of sheets, nearly horizontal, is stacked; a sheet conveying unit that includes an endless belt member, which faces a top surface of a topmost sheet positioned at top of the sheets stacked in the sheet housing unit and is disposed to have a gap from the top surface of the topmost sheet when feeding of the sheets stacked in the sheet housing unit is not performed, and a suction unit disposed inside the belt member, the sheet conveying unit attracting the topmost sheet on an outer surface of the belt member by generating a negative pressure in the suction unit and conveying the attracted topmost sheet towards a subsequent step by endlessly moving the belt member; and a sheet lifting unit that lifts the topmost sheet to a position where the topmost sheet is attracted on the surface of the belt member by the negative pressure generated by the suction unit, wherein the feeding device is configured to be connected to another feeding device that houses sheets and to feed the sheet fed from the other feeding device to the subsequent step, the feeding device further comprises an external device sheet conveying unit that conveys the sheet fed from the other feeding device to the gap between the topmost sheet in the sheet housing unit and the belt member, and in feeding the sheet fed from the other feeding device to the subsequent step, the sheet lifting unit is stopped while the suction unit, the belt member, and the external device sheet conveying unit are operated.

According to another aspect of the present invention, there is provided an image forming apparatus including: an image forming section that forms an image on a sheet of a recording medium; and a paper feeding unit that feeds the sheet to the image forming section and includes: a sheet housing unit in which the plurality of sheets, nearly horizontal, is stacked; a sheet conveying unit that includes an endless belt member, which faces a top surface of a topmost sheet positioned at top of the sheets stacked in the sheet housing unit and is disposed to have a gap from the top surface of the topmost sheet when feeding of the sheets stacked in the sheet housing unit is not performed, and a suction unit disposed inside the belt member, the sheet conveying unit attracting the topmost sheet on an outer surface of the belt member by generating a negative pressure in the suction unit and conveying the attracted topmost sheet towards a subsequent step by endlessly moving the belt member; and a sheet lifting unit that lifts the topmost sheet to a position where the topmost sheet is attracted on the surface of the belt member by the negative pressure generated by the suction unit, wherein the feeding device is configured to be connected to another feeding device that houses sheets and to feed the sheet fed from the other feeding device to the subsequent step, the feeding device further comprises an external device sheet conveying unit that conveys the sheet fed from the other feeding device to the gap between the topmost sheet in the sheet housing unit and the belt member, and in feeding the sheet fed from the other feeding device to the subsequent step, the sheet lifting unit is stopped while the suction unit, the belt member, and the external device sheet conveying unit are operated.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of a feeding device to which the present invention is applied will be described below. The overall structure and operation of an image forming apparatus body connectable with the feeding device according to an embodiment of the present invention will be explained.

Figure 2:
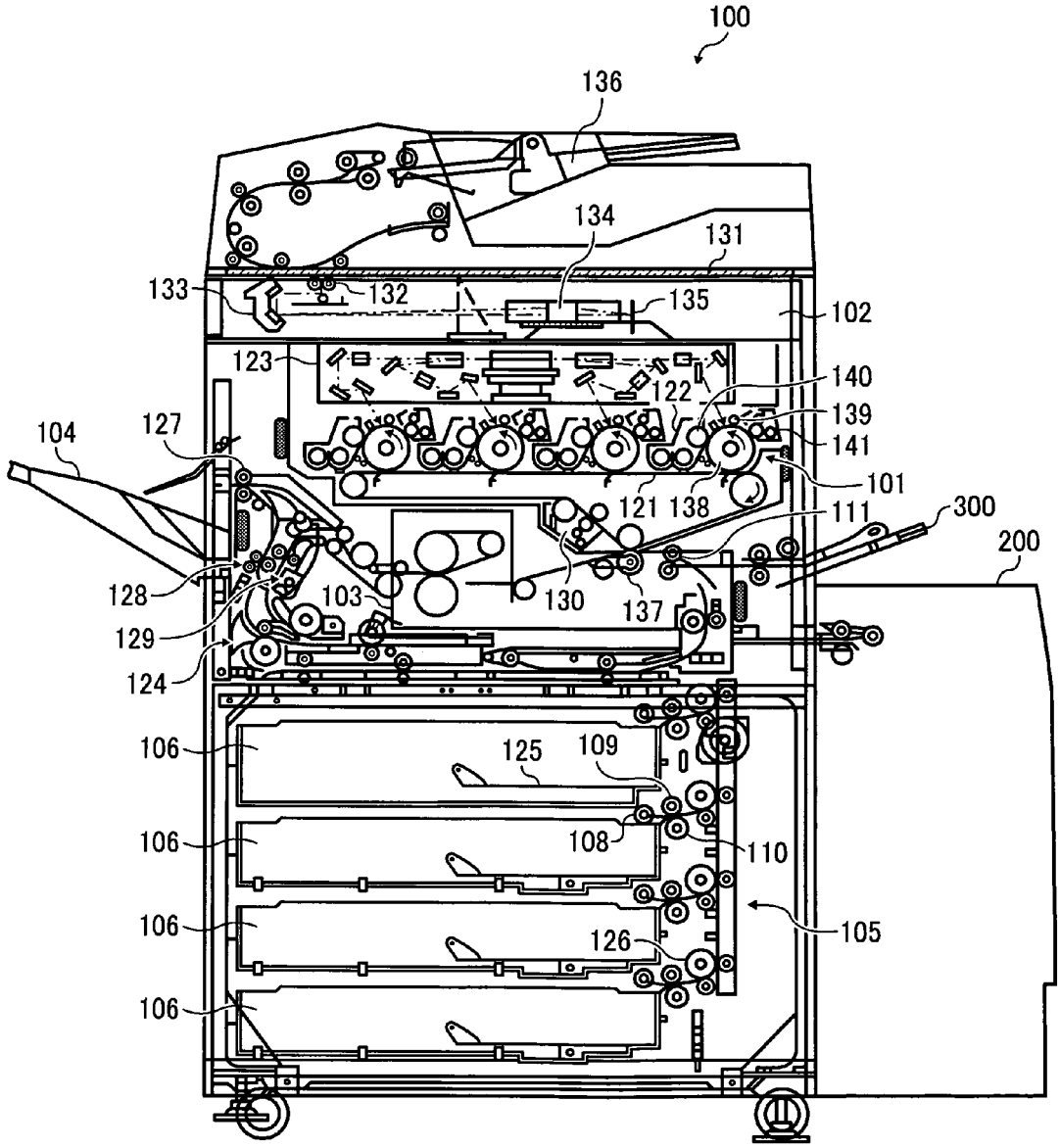
FIG. 2 is a diagram explaining a copying machine that is the image forming apparatus body according to the embodiment.

FIG. 2 is a schematic diagram illustrating the structure of a copying machine 100 that is the image forming apparatus body according to the present embodiment.

The copying machine 100 has functions as a so-called digital color copying machine that reads an original by scanning, digitalizes the original thus read, and duplicates the original onto a sheet.

As depicted in FIG. 2, the copying machine 100 is provided with components such as an image forming section 101, a scanning unit 102, a fixing unit 103, and a discharging unit 104. On the lower portion of the copying machine 100, a multi-stage paper feeding unit 105 is provided. In stages of the paper feeding unit 105, main body paper feed trays 106, each of which is stacked with a recording medium in sheet such as plain paper, coated paper including coat paper, and an OHP transparency sheet (hereinafter, referred to as sheet) are arranged, respectively. In each of the main body paper feed trays 106, a main body tray bottom plate 125, a pick-up roller 108, a feed roller 109, a reverse roller 110, and a paper feeding roller 126 are disposed. The main body tray bottom plate 125 is structured to move up and down in the vertical direction depending on the remaining number of sheets stacked inside the main body paper feed tray 106. The pick-up roller 108 gives the sheet at the top of the sheets placed a force to go forward and conveys the sheet towards a pair of rollers composed of the feed roller 109 and the reverse roller 110. The feed roller 109 and the reverse roller 110 form a separating unit that conveys only a single sheet at the top towards the paper feeding roller 126 when a plurality of sheets is conveyed by the pick-up roller 108.

More specifically, a single sheet at the top in the main body paper feed tray 106 is supplied by the rotation of the pick-up roller 108 and is separated one by one by the reverse roller 110.

The separated sheet is sent out from the main body paper feed tray 106 by the rotation of the feed roller 109 and the paper feeding roller 126 and is conveyed to a pair of registration rollers 111 in the image forming section 101 disposed on the downstream side in the sheet conveying direction. The sheet thus separated and conveyed is temporarily held to wait by abutting on a nip of the pair of registration rollers 111. The sheet is then sent to a secondary transfer nip for image forming.

The scanning unit 102 is provided with an exposure glass 131 the upper surface of which is brought into contact with a scanning surface of the original, and a lens 134 and a CCD camera 135 for reading an original image as image information. The scanning unit 102 is also provided with a first traveling body 132 that has a light source and a reflective mirror and moves corresponding to a document read position, and a second traveling body 133 that moves in response to the movement of the first traveling body 132 so that the distance of an optical path from the reflective mirror in the first traveling body 132 to the CCD camera 135 remains constant. On the upper portion of the scanning unit 102, an automatic document feeder 136 is disposed.

In the substantially central portion of the image forming section 101, an intermediate transfer belt 121 is disposed and, on the upper portion of the intermediate transfer belt 121, four units of image forming units 122 which form toner images in respective colors on photosensitive elements 138 corresponding to the respective colors are disposed. In the periphery of the photosensitive element 138 of each image forming unit 122, a charging unit 139 that uniformly charges the surface of the photosensitive element 138, a developing unit 140 that develops a latent image formed on the surface of the photosensitive element 138 as a toner image, a photosensitive element cleaning device 141 that removes the toner image remaining on the surface of the photosensitive element 138 after the toner image is transferred onto the intermediate transfer belt 121, and the like are disposed. Above the four image forming units 122, an exposing unit 123 that irradiates the photosensitive elements of the image forming units 122 of respective colors with exposure lights corresponding to the respective colors to form the latent images on the photosensitive elements is disposed.

Below the intermediate transfer belt 121, a secondary transfer roller 137 that forms the secondary transfer nip with the intermediate transfer belt 121 therebetween is disposed. On the downstream side in a moving direction of the surface of the intermediate transfer belt 121 from the secondary transfer nip, an intermediate transfer belt cleaning device 130 that removes residual toner remaining on the surface of the intermediate transfer belt 121 after passing through the secondary transfer nip is disposed.

Further below the fixing unit 103 disposed below the intermediate transfer belt 121, a duplex device 124 that conveys the sheet having an image formed on its front surface by the fixing unit 103 towards the transfer position with its rear surface facing up is disposed. On the left side of the fixing unit 103 in FIG. 2, discharging rollers 127 that discharge the sheet having an image formed on its front surface by the fixing unit 103 towards the discharging unit 104 are disposed. Further below the discharging rollers 127, reverse discharging rollers 128 that discharge the sheet to the discharging unit 104 such that the front surface of the sheet having an image formed faces downward are disposed. Between the fixing unit 103 and the discharging rollers 127, a bifurcating claw 129 that switches a feed path of the sheet passing through the fixing unit 103 to a feed path heading towards the discharging rollers 127 or a feed path heading towards the reverse discharging rollers 128 or the duplex device 124 is disposed.

The copying machine 100 according to the present embodiment is provided with a feeding device 200 as a separate paper feeding unit from the paper feeding unit 105, and a bypass tray 300 above the feeding device 200. When image forming is performed, sheets are sequentially supplied being separated one by one from the main body paper feed tray 106 selected in the paper feeding unit 105, the bypass tray 300, or the feeding device 200.

The feeding device 200 according to the present embodiment will be described.

Figure 1:
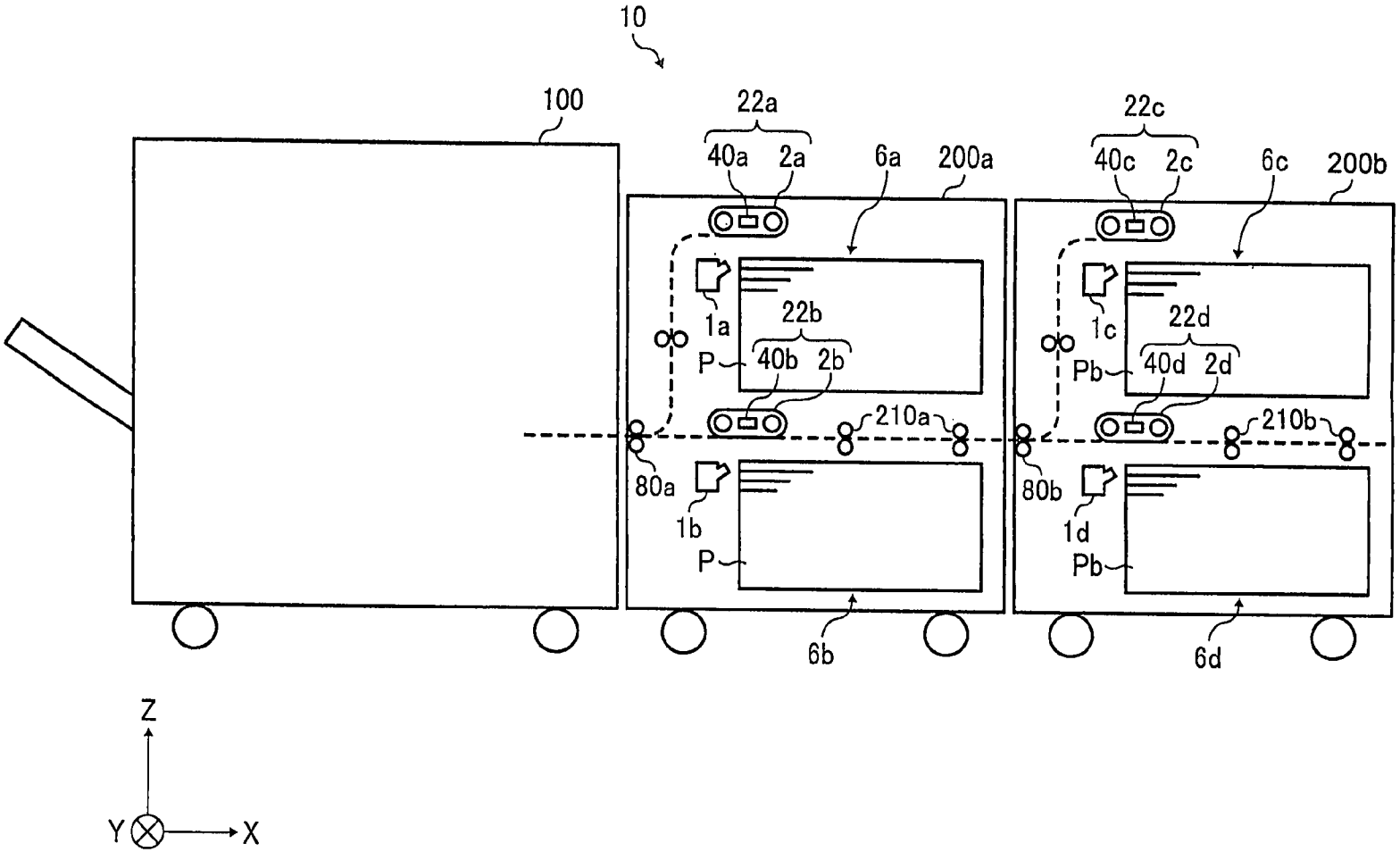
FIG. 1 is a diagram explaining an image forming apparatus according to an embodiment of the present invention.

FIG. 1 is a diagram explaining an image forming apparatus 10 connected with two units of the feeding devices 200 (200*a* and 200*b*) that sequentially supplies the sheets to the copying machine 100.

As depicted in FIG. 1, each of the two feeding devices 200 is provided with an upper paper feed tray 6 (6*a* or 6*c*) and a lower paper feed tray 6 (6*b* or 6*d*). Above each of the four paper feed trays 6, a suction belt 2 and a suction device 40 that separate and feed paper P stacked in the paper feed tray 6 are disposed. Each of the two feeding devices 200 is structured with a pair of exit rollers 80 (80*a* or 80*b*) provided at the downstream end portion of the feed path in the feeding device to feed the paper P to the subsequent step.

Figure 3:
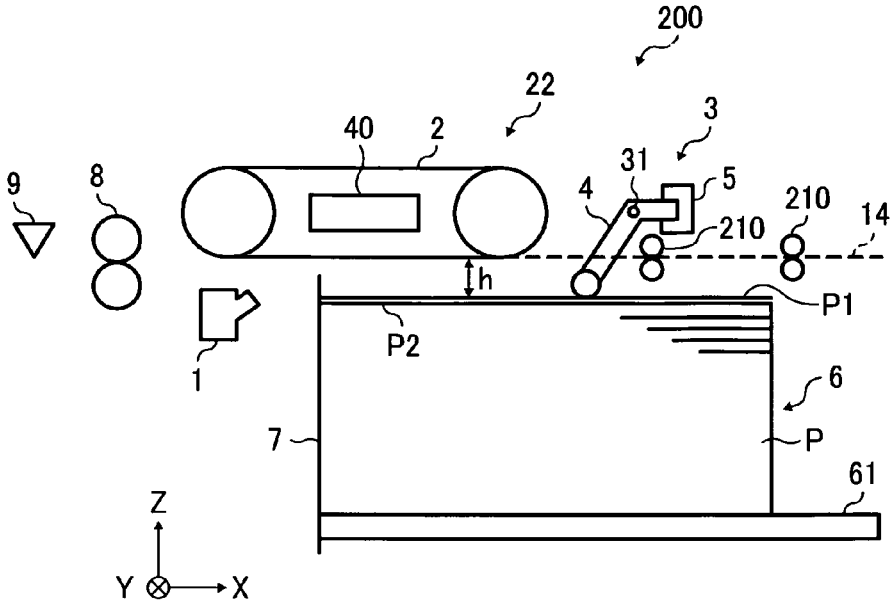
FIG. 3 is a diagram explaining an overview of a feeding device illustrating the vicinity of a paper feed tray.
Figure 4:
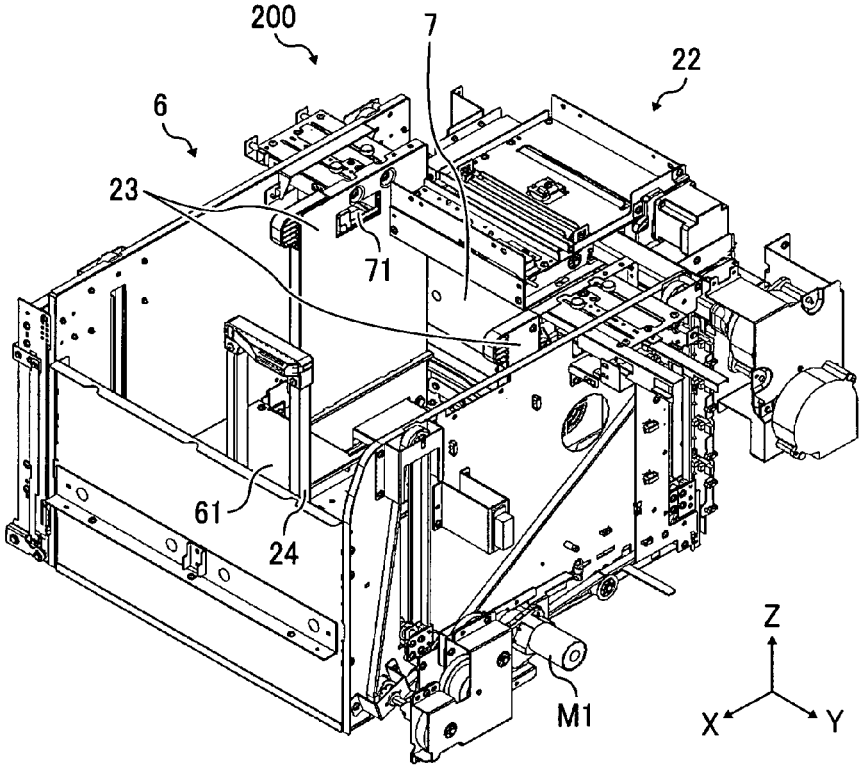
FIG. 4 is a perspective view illustrating the vicinity of the paper feed tray depicted in FIG. 3.

FIG. 3 is a schematic diagram illustrating the vicinity of the first lower paper feed tray 6*b* disposed in the lower portion of the first feeding device 200*a* out of the four paper feed trays 6. FIG. 4 is a perspective view illustrating the vicinity of the first lower paper feed tray 6*b* depicted in FIG. 3. In FIG. 4, illustration of a pair of upstream side paper carriage rollers 210 is omitted. The structure of the vicinity of the second lower paper feed tray 6*d* disposed in the lower portion of the second feeding device 200*b* out of the other three paper feed trays 6 is the same as that depicted in FIG. 3. The other two paper feed trays 6, i.e., the first upper paper feed tray 6*a* and the second upper paper feed tray 6*c* disposed at the upper portion of each feeding device 200 only differ in terms of the pair of upstream side paper carriage rollers 210 not being provided, and other structure is the same as that depicted in FIG. 3.

As depicted in FIGS. 3 and 4, the feeding device 200 is provided with the paper feed tray 6 that is a sheet housing unit provided with a bottom plate 61 where a bundle of the paper P that is a plurality of sheets is stacked. Above the paper feed tray 6, a paper feed unit 22 provided with the suction belt 2 and the suction device 40 is disposed. The suction belt 2 has suction holes opened penetrating from the front surface through the rear surface of the belt over the entire belt in its circumferential direction. When the suction device 40 generates a negative pressure below, it acts on the paper P to be attracted on the bottom surface of the suction belt 2. The paper feed unit 22 thus structured forms a sheet conveying unit that picks up the paper P one by one at the top of the bundle of the paper P placed in the paper feed tray 6 and feeds sheets to the copying machine 100 that is the image forming apparatus body.

As depicted in FIG. 4, in the paper feed tray 6, side fences 23 that guide side surfaces of the bundle of the paper P stacked on the bottom plate 61 in its width direction (direction orthogonal to the feeding direction) are provided on both sides and an end fence 24 that holds the trailing edge portion at the back of the bundle of the paper P in the feeding direction is provided.

On the side fence 23, a side air outlet 71 that is an outlet for the air from a blowing unit used for lifting and separating the paper P is provided. The feeding device 200 of the present embodiment is center-referenced so that both of the two side fences 23 are moved according to the paper size. Consequently, regardless of the paper size, the air blown out from a center air outlet 11 can be blown towards the center of the paper P.

The feeding device 200 is provided with a sheet top sensor 3 on the upstream side in the sheet conveying direction (direction going from right to left in FIG. 3) from the suction belt 2. In the feeding device 200, it is necessary to maintain a distance h between the top surface of the topmost paper P1 of the paper P in the paper feed tray 6 that decreases in number by feeding and the bottom surface of the suction belt 2 within a certain range. Accordingly, the height of the top surface of the topmost paper P1 is detected by the sheet top sensor 3 and, based on a detecting signal of the sheet top sensor 3, the drive of a bottom plate elevating motor M1 that is a driving source of an elevating mechanism not depicted that moves the bottom plate 61 of the paper feed tray 6 up and down is controlled. Consequently, the height of the bottom plate 61 is adjusted and controlled such that the distance h between the top surface of the topmost paper P1 of the paper P placed on the bottom plate 61 and the bottom surface of the suction belt 2 is within the certain range. In the feeding device 200 of the present embodiment, the sheet top sensor 3 is mounted on a frame of the paper feed unit 22.

Figure 5:
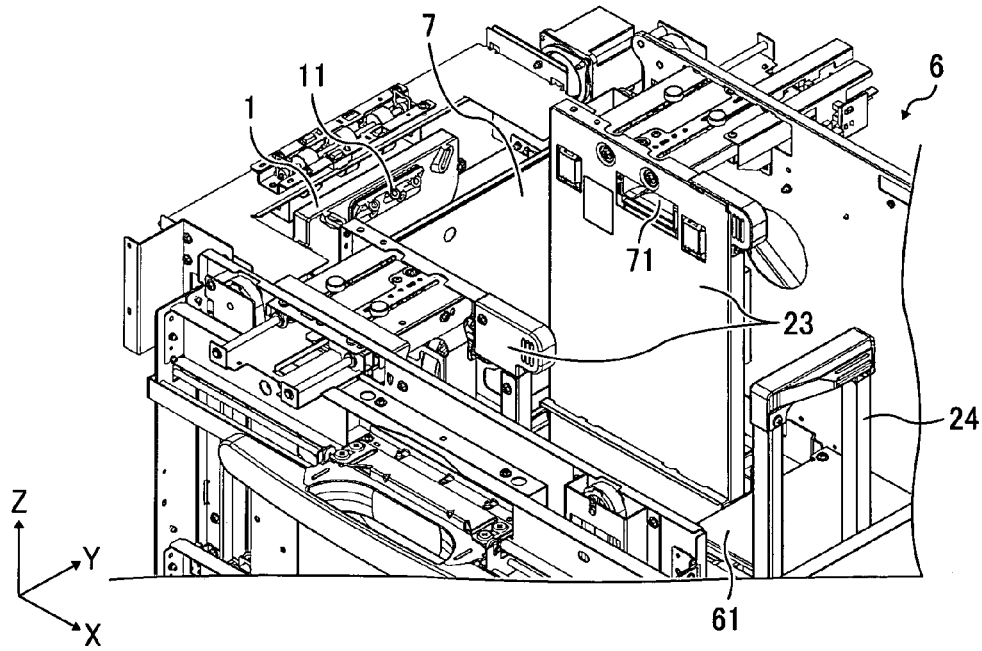
FIG. 5 is a perspective view illustrating the vicinity of the paper feed tray with a paper feed unit removed from the state depicted in FIG. 4.

FIG. 5 is a perspective view illustrating the vicinity of the paper feed tray 6 with the paper feed unit 22 being removed from the state depicted in FIG. 4.

As depicted in FIG. 5, above a paper hold-back member 7 arranged directly under the paper feed unit 22, a blowing device 1 that lifts and separates sheets by blowing air from the center air outlet 11 is disposed.

In the feeding device 200, the blowing device 1 such as a blower blows air towards the leading edge portion and side edge portions of the sheets of the paper P stacked in the paper feed tray 6. By the blowing of air, the air is sent between the sheets of the paper P to lift the topmost paper P1 to the height of the suction belt 2 and to have the topmost paper P1 attracted on the suction belt 2 by the negative pressure the suction device 40 generates.

While the topmost paper P1 is attracted on the suction belt 2, a belt driving motor 26 is driven to move the suction belt 2 in endless movement in the clockwise direction indicated in FIG. 3 to make the suction belt convey the topmost paper P1 to the copying machine 100 and then, image forming is performed.

The blowing device 1 not only lifts the topmost paper P1 to a given height by pumping air between the sheets of the paper P, but also separates the sheets by blowing air to the area in a direction of the given height.

Between the blowing device 1 and the paper P, the paper hold-back member 7 is disposed to hold back the leading edge portion of the bundle of the paper P preventing sheets other than the topmost paper P1 from being conveyed. The sheet top sensor 3 that detects the height of the top surface of the topmost paper P1 by abutting on the topmost surface of the bundle of the paper P is provided to maintain the distance h between the position of the top surface of the bundle of the paper P that decreases in number by feeding the paper P and the suction belt 2 to be constant. The sheet top sensor 3 has an actuator 4 and a photo sensor 5 that detects the position of the actuator 4.

In the feeding device 200, the actuator 4 swings by the reduction of the paper P in number and the photo sensor 5 detects changes of the position by the swing. Based on this detection signal, the drive of the bottom plate elevating motor M1 is controlled to raise the bottom plate 61 by the elevating mechanism not depicted so as to control the distance h between the top surface of the topmost paper P1 of the paper P placed on the bottom plate 61 and the bottom surface of the suction belt 2 to be within a constant range.

The bundle of the paper P is aligned with the surface of the leading edge as a reference surface to fit the paper size in the paper feed tray 6.

On the downstream side in the conveying direction from the suction belt 2, a pair of carriage rollers 8 is disposed to further convey the paper P, which has been conveyed by the suction belt 2 and reached between the two rollers, towards the downstream side. The force to go forward of the pair of carriage rollers 8 is arranged to be greater than that of the suction belt 2. On the downstream side in the conveying direction from the pair of carriage rollers 8, a feed sensor 9 that detects the passing of the paper P is provided.

The feeding operation performed by the feeding device 200 illustrated in FIG. 3 will be explained.

When a command to start feeding is received from a control unit of the copying machine 100, while the suction belt 2 is being stopped, the blowing of the blowing device 1 and the suction of the suction device 40 are started. When the blowing device 1 is started to blow air, the air is blown to the leading edge portion of the paper P and the topmost paper P1 of the stacked paper P is lifted. When the suction device 40 starts sucking, a negative pressure is generated below the suction device 40 and the topmost paper P1 lifted is attracted on the suction belt 2.

After an elapse of a given time (for example, 3 seconds) from the start of the blowing of the blowing device 1 and the suction of the suction device 40, while the blowing device 1 and the suction device 40 are in operation, the drive of the suction belt 2 and the pair of carriage rollers 8 is started. The suction belt 2 receives the drive transmitted and starts the surface movement of the suction belt 2 in the clockwise direction indicated in FIG. 3. This results in the topmost paper P1 attracted on the bottom surface of the suction belt 2 being conveyed towards the downstream side in the conveying direction and reaching the pair of carriage rollers 8. The topmost paper P1 is then further conveyed to the downstream side by the pair of carriage rollers 8.

When the leading edge of the topmost paper P1 conveyed by the suction belt 2 and the pair of carriage rollers 8 is detected by the feed sensor 9, the drive of the suction belt 2 is stopped.

The reason to control the drive of the suction belt 2 to be stopped in this way is as follows. That is, if the suction belt 2 is driven continuously, at the time of the topmost paper P1 starts passing through the suction area of the suction device 40 as the topmost paper P1 is conveyed, a next topmost paper P2 that is the subsequent paper P below the topmost paper P1 is also attracted on the suction belt 2. If the suction belt 2 is driven at this time, the next topmost paper P2 may be conveyed together with the topmost paper P1 resulting in so-called double feed.

Accordingly, when the leading edge of the topmost paper P1 is detected by the feed sensor 9, the drive of the suction belt 2 is stopped. The topmost paper P1 at this point is sandwiched between the two rollers of the pair of carriage rollers 8. Because the pair of carriage rollers 8 is continued to be driven even after the drive of the suction belt 2 is stopped, the topmost paper P1 is continued to be conveyed. In this case, if the force to go forward by the pair of carriage rollers 8 is smaller than that of the suction belt 2, the topmost paper P1 is held stuck on the suction belt 2 and the conveyance of the topmost paper P1 is stopped. Accordingly, as described above, the force to go forward given by the pair of carriage rollers 8 is arranged to be greater than that of the suction belt 2.

By continuing to drive the pair of carriage rollers 8 even after the drive of the suction belt 2 is stopped, the conveyance of the topmost paper P1 is continued.

While the topmost paper P1 is attracted on the suction belt 2, the leading edge portion of the next topmost paper P2 flaps below the topmost paper P1 as it receives the blowing air from the blowing device 1. Accordingly, the leading edge portion of the next topmost paper P2 is being separated from the paper P below.

Then, immediately after the trailing edge portion of the topmost paper P1 passes through the suction area of the suction device 40, by the flow of the air formed between the blowing device 1 and the suction device 40, the next topmost paper P2 is lifted and attracted on the suction belt 2.

According to the predetermined feeding interval, the drive of the suction belt 2 is then resumed after an elapse of a given time from the operational timing of the feed sensor 9 detecting the leading edge of the topmost paper P1. Consequently, similarly to the topmost paper P1, the next topmost paper P2 is conveyed by the suction belt 2 towards the downstream side in the conveying direction to reach the pair of carriage rollers 8, and is further conveyed towards the downstream side by the pair of carriage rollers 8.

While the blowing device 1, the suction device 40, and the pair of carriage rollers 8 are in operation, repeating the controls of setting off the drive of the suction belt 2 when the feed sensor 9 detects the leading edge of the paper P and setting on the drive of the suction belt 2 after an elapse of the given time from the operational timing of the feed sensor 9 detecting the leading edge of the paper P makes the paper P in the paper feed tray 6 to be sequentially fed one by one towards the copying machine 100.

Figure 6:
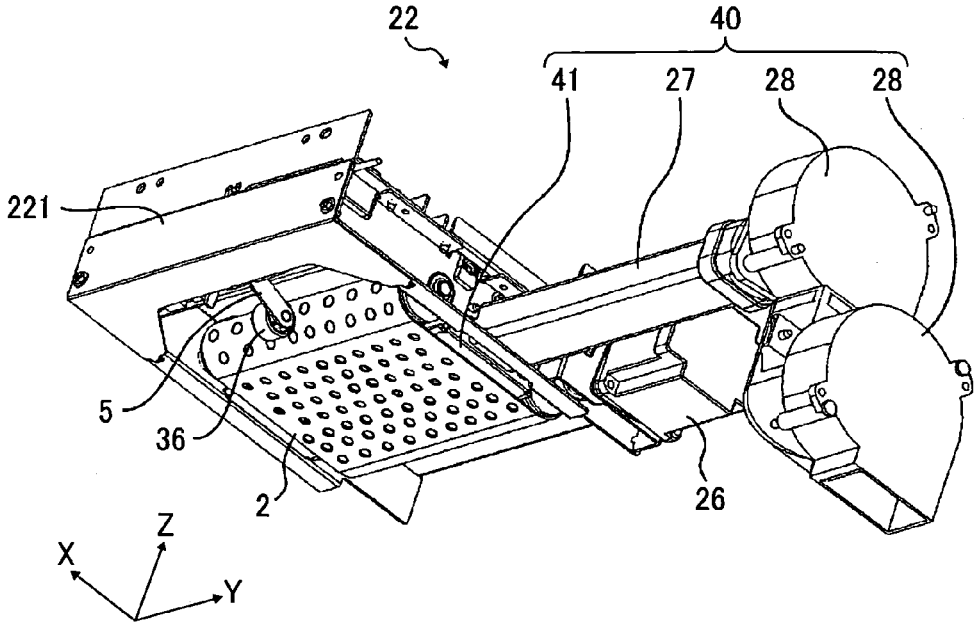
FIG. 6 is a perspective view of the paper feed unit viewed from below.

FIG. 6 is a perspective view of the paper feed unit 22 viewed from below.

The paper feed unit 22 is provided with the suction belt 2 with suction holes opened in the entire circumferential area and the belt driving motor 26 connected to the suction belt 2. By driving the belt driving motor 26 at predetermined operational timing, the suction belt 2 can be rotary driven.

Inside the suction belt 2, a suction chamber 41 is provided. The suction chamber 41 is connected to a suction blower 28 via a suction duct 27 and is structured to maintain an appropriate static suction pressure at an opening portion not depicted of the suction chamber 41. Accordingly, in the feeding device 200, the suction chamber 41, the suction duct 27, and the suction blower 28 form the suction device 40. By driving the suction blower 28, the suction is performed through the suction holes of the suction belt 2 at the position facing the opening portion of the suction chamber 41 not depicted.

Figure 7:
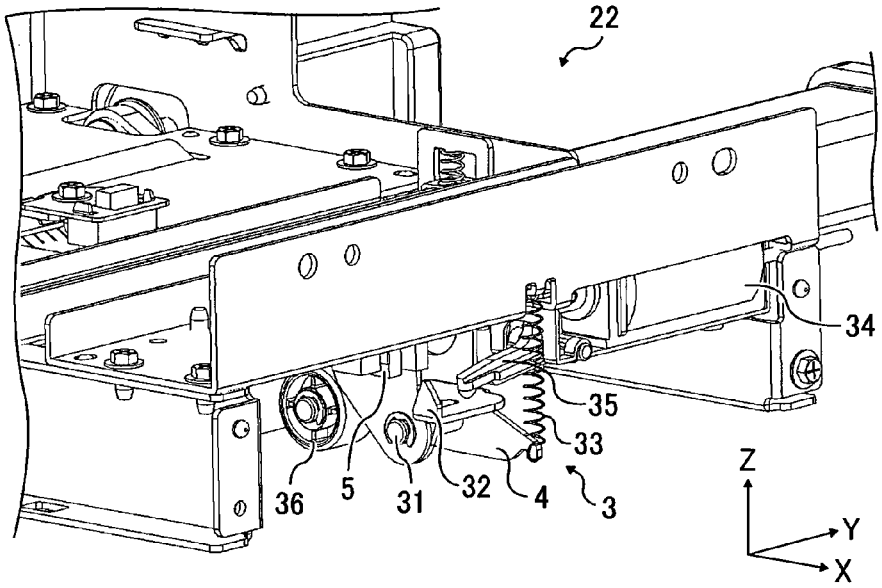
FIG. 7 is an enlarged perspective view of the paper feed unit near the rear end in a sheet height non-detecting state.
Figure 8:
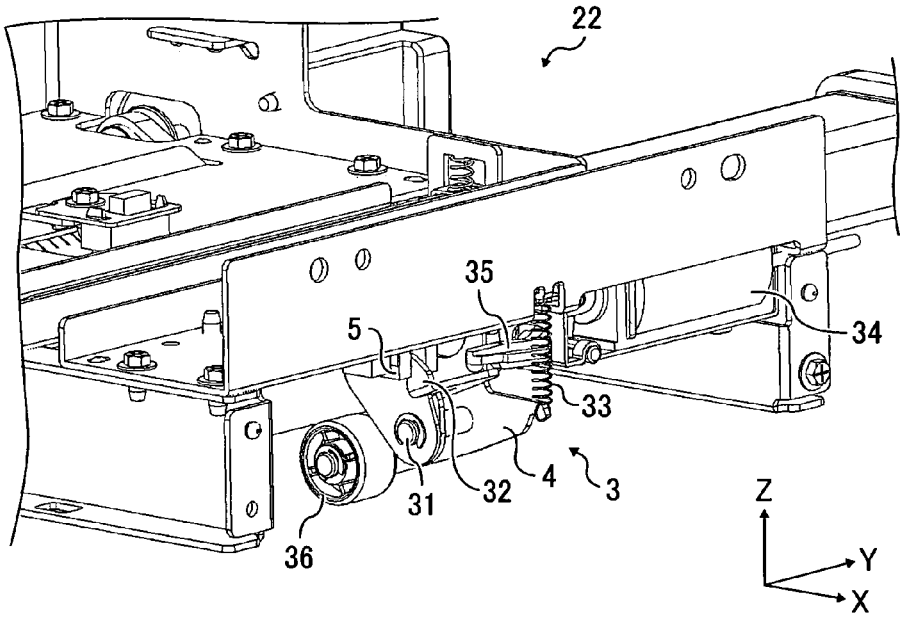
FIG. 8 is an enlarged perspective view of the paper feed unit near the rear end in a sheet height detecting state.

FIGS. 7 and 8 are enlarged perspective views of the paper feed unit 22 near the rear end portion in the sheet conveying direction with a unit rear end plate 221 at the rear end of the paper feed unit 22 being removed. FIG. 7 is the enlarged perspective view when the height of the top surface of the topmost paper P1 is not detected by the sheet top sensor 3, and FIG. 8 is the enlarged perspective view when the height of the top surface of the topmost paper P1 is detected by the sheet top sensor 3.

The actuator 4 of the sheet top sensor 3 is pivotally mounted via a support shaft 31 to the frame of the paper feed unit 22. On one end of the actuator 4, a filler 36 that is actually brought into contact with the sheets and detects the height of the sheets is provided and, on the other end of the actuator 4 opposite to the filler 36 across the support shaft 31, a position detecting portion 32 the position of which is detected by the photo sensor 5 is provided.

With reference to FIGS. 9 to 12, the detection of the height of the top surface of the topmost paper P1 by the sheet top sensor 3 and the control of the height of the top surface of the topmost paper P1 performed based on the detection will be explained.

Figure 9:
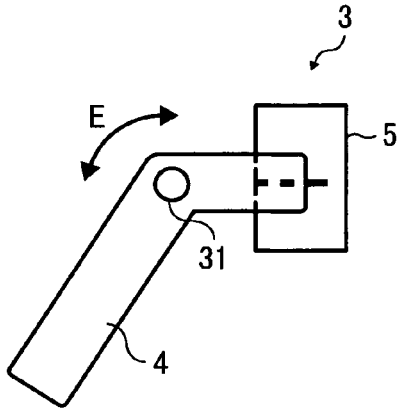
FIG. 9 is a schematic diagram of a sheet top sensor.

FIG. 9 is a schematic diagram of the sheet top sensor 3. As indicated by the arrow E in FIG. 9, the actuator 4 is rotatable about the support shaft 31.

Figure 10:
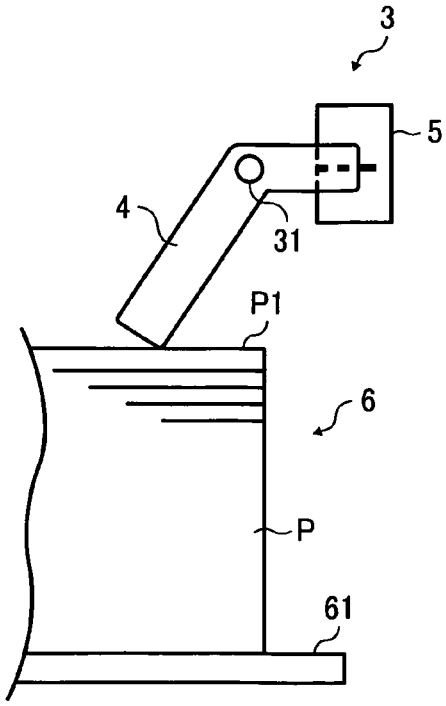
FIG. 10 is a diagram explaining the height of a top surface of a topmost sheet being in a normal state.

FIG. 10 is a diagram explaining the height of the top surface of the topmost paper P1 of the paper P stacked in the paper feed tray 6 being in a normal state. In this case, the position detecting portion of the actuator 4 is positioned at the detecting position of the photo sensor 5, and thus the photo sensor 5 is in a detecting state.

Figure 11:
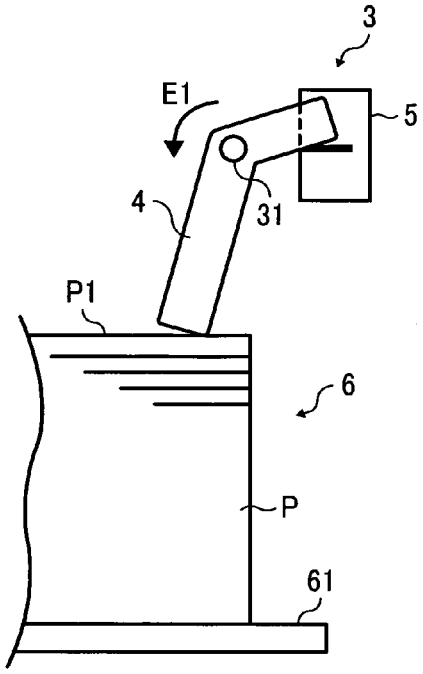
FIG. 11 is a diagram explaining the height of the top surface of the topmost sheet being below the normal position.

When the number of paper P is decreased by feeding from the condition illustrated in FIG. 10, as depicted in FIG. 11, the height of the top surface of the topmost paper P1 is lowered and the actuator 4 rotates in the arrow E1 direction indicated in FIG. 11. Under this condition, the position detecting portion of the actuator 4 is not positioned at the detecting position of the photo sensor 5, and thus the photo sensor 5 is in a non-detecting state.

Figure 12:
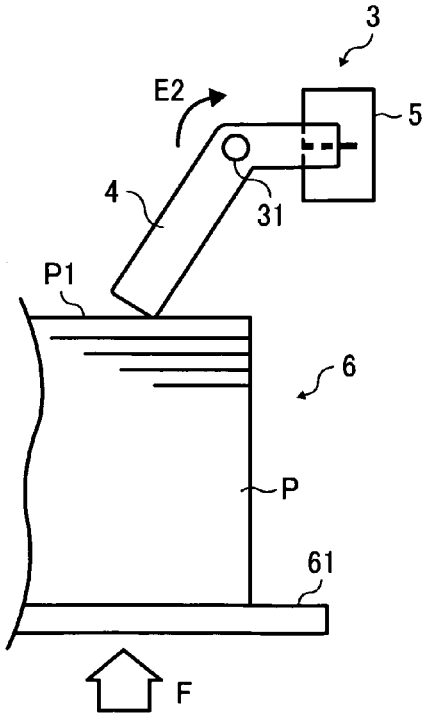
FIG. 12 is a diagram explaining a bottom plate being elevated from the state depicted in FIG. 11.

As depicted in FIG. 11, when the photo sensor 5 is in the non-detecting state, the bottom plate elevating motor M1 is driven to operate the elevating mechanism not depicted to raise the bottom plate 61 as indicated by the arrow F in FIG. 12.

When the bottom plate 61 is raised from the condition depicted in FIG. 11, as depicted in FIG. 12, the height of the top surface of the topmost paper P1 is raised and thus, the actuator 4 rotates in the arrow E2 direction indicated in FIG. 12. Accordingly, the position detecting portion of the actuator 4 comes to the detecting position of the photo sensor 5, and thus the photo sensor 5 becomes the detecting state again. As depicted in FIG. 12, when the photo sensor 5 becomes the detecting state, the drive of the bottom plate elevating motor M1 is halted to stop raising the bottom plate 61 by the elevating mechanism.

With the sheet top sensor 3 thus structured, the photo sensor 5 can detect the position of the actuator 4 and thus, the position of the topmost surface of the bundle of the paper P can be detected by the actuator 4 and the photo sensor 5. To keep the feeding position of the paper P constant without varying even when the number of paper P remaining becomes small, the drive of the bottom plate elevating motor M1 is controlled to move the bottom plate 61 up and down based on the detecting result of the sheet top sensor 3, whereby the feeding position of the paper P is controlled.

Further, the feeding device 200 is provided with a position switching mechanism that switches the position of the actuator 4 of the sheet top sensor 3 to up and down positions. In the present embodiment, an actuator spring 33, a pressure arm 35, and a pressure motor 34 form the position switching mechanism. One end of the actuator spring 33 is fixed to the frame of the paper feed unit 22 and the other end is fixed to the end portion of the actuator 4 on the position detecting portion 32 side.

FIG. 7 depicts the actuator 4 in the up position, and FIG. 8 depicts the actuator 4 in the down position. The detection of the height of the top surface of the topmost paper P1 by the sheet top sensor 3 is performed only when the actuator 4 is set in the down position, and not detected in the up position.

While the pressure motor 34 is stopped, as depicted in FIG. 8, the actuator spring 33 acts on the end portion of the actuator 4 on the position detecting portion 32 side to pull up. By this action, the opposite end portion of the actuator 4 across the support shaft 31 is lowered and the filler 36 is brought into contact with the top surface of the topmost paper P1. In other words, stopping the pressure motor 34 to set the actuator 4 in the down position turns the detection of the height of the top surface of the topmost paper P1 by the sheet top sensor 3 to an on-state.

On the other hand, when the pressure motor 34 is driven, as depicted in FIG. 7, the pressure arm 35 is lowered and then is brought into contact with the end portion of the actuator 4 on the position detecting portion 32 side and presses the end portion down. By this downward pressing, the opposite end portion of the actuator 4 across the support shaft 31 is raised and the filler 36 is separated from the top surface of the topmost paper P1. In other words, driving the pressure motor 34 to set the actuator 4 in the up position turns the detection of the height of the top surface of the topmost paper P1 by the sheet top sensor 3 to an off-state.

The drive of the pressure motor 34 that switches the detection by the sheet top sensor 3 on and off is controlled by a control unit not depicted provided on the feeding device 200.

Figure 13:
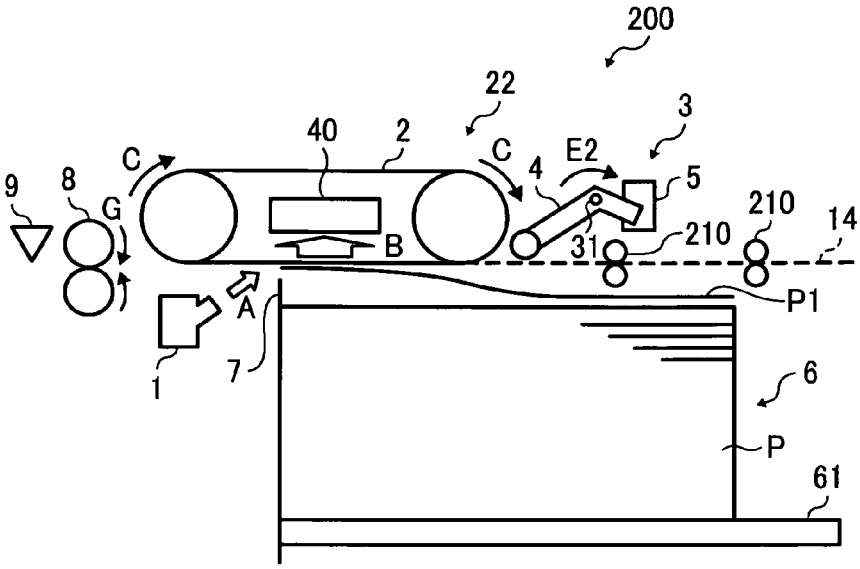
FIG. 13 is a diagram explaining the feeding device at the operational timing of the topmost sheet being lifted.
Figure 14:
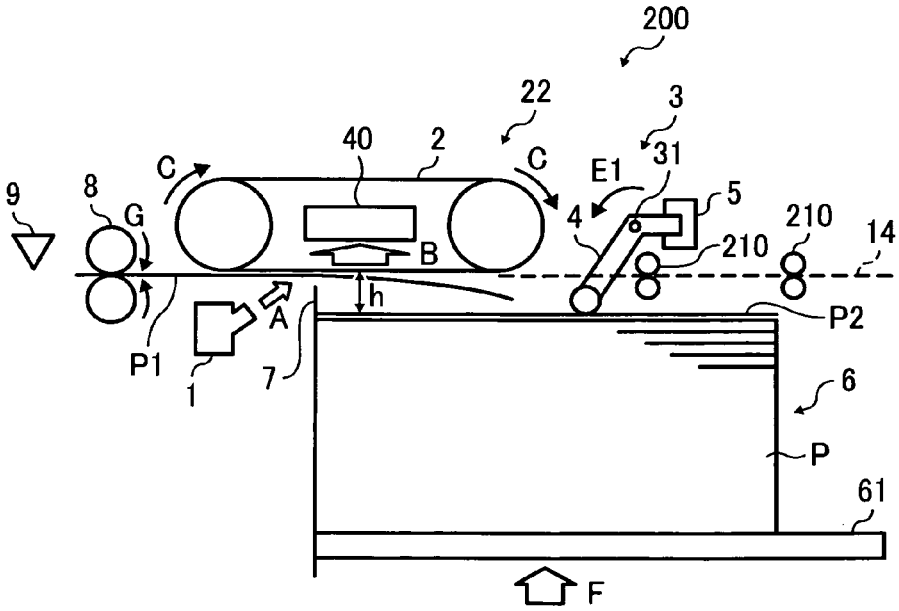
FIG. 14 is a diagram of the feeding device explaining the detection of sheet height.

FIG. 13 is a diagram of the feeding device 200 of the present embodiment explaining the operational timing of the topmost paper P1 being lifted, and FIG. 14 is a diagram explaining the operational timing of the leading edge of the topmost paper P1 passing the pair of carriage rollers 8.

By providing the position switching mechanism that switches the up and down positions of the actuator 4 of the sheet top sensor 3, as depicted in FIG. 13, when lifting a sheet, the position of the actuator 4 is set to the up (sheet height non-detecting state) position so that there is no adverse impact in lifting the sheet.

As depicted in FIG. 14, when the topmost paper P1 is attracted on the suction belt 2 and reaches the pair of carriage rollers 8, the position of the actuator 4 is set to the down (sheet height detecting state) position. Consequently, the height of the top surface of the next topmost paper P2 can be detected without having an adverse effect on the feeding of the topmost paper P1, thereby allowing the distance h aimed to be maintained.

Accordingly, the actuator 4 of the feeding device 200 of the present embodiment moves up and down to repeat contacting with and separating from the topmost surface of the paper P each time a single sheet of paper P in the paper feed tray 6 is fed. This makes it possible to detect the topmost surface of the paper P for maintaining the feeding position of the paper P constant without imparting any impact in lifting the sheet.

In the conventional feeding device 200 explained with reference to FIGS. 16 to 20, it is structured that, by mounting the sheet top sensor 3 provided with the actuator 4 on the end fence 24, the mounting position of the actuator 4 is changed according to the difference in position near the rear end of the paper P for sheet size. In the conventional feeding device 200, by mounting the sheet top sensor 3 on the end fence 24, the mounting position of the actuator 4 can be set near the trailing edge of sheets where blowing by the blowing device 1 is not likely to be affected.

The features of the feeding device 200 according to the present embodiment will be described.

The first feeding device 200*a* according to the present embodiment is connected to the second feeding device 200*b* that is another feeding device housing the paper P, and is structured to be able to feed the paper P fed from the second feeding device 200*b* to the copying machine 100.

Figure 15:
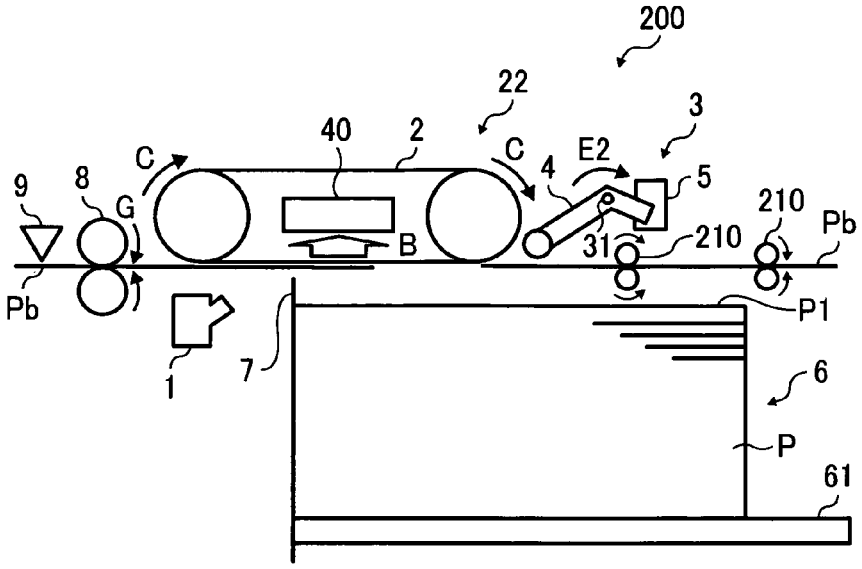
FIG. 15 is a diagram explaining a sheet on the upstream side passing the feeding device.
Figure 16:
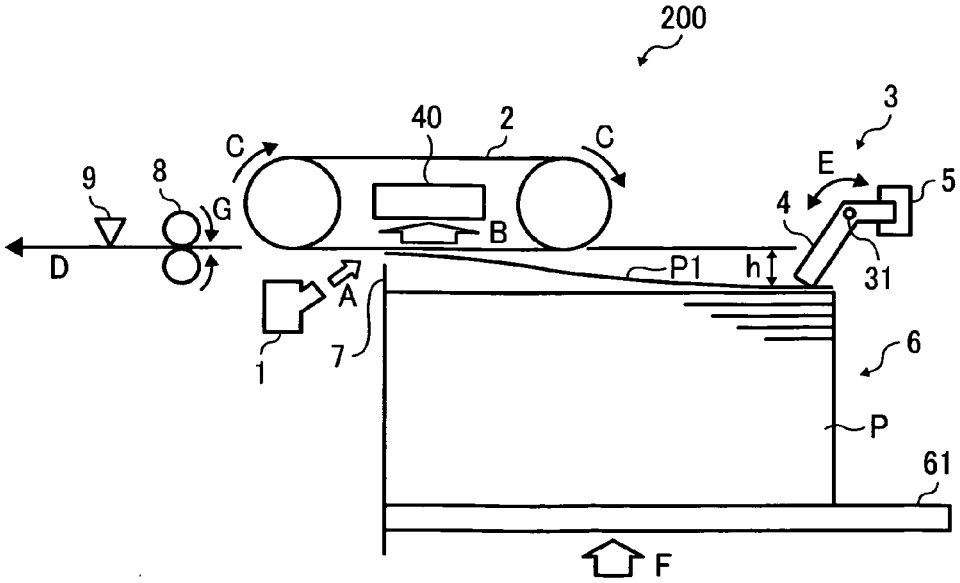
RELATED ART FIG. 16
FIG. 16 is a diagram explaining an example of the feeding device that separates and feeds sheets using the flow of air.
Figure 17:
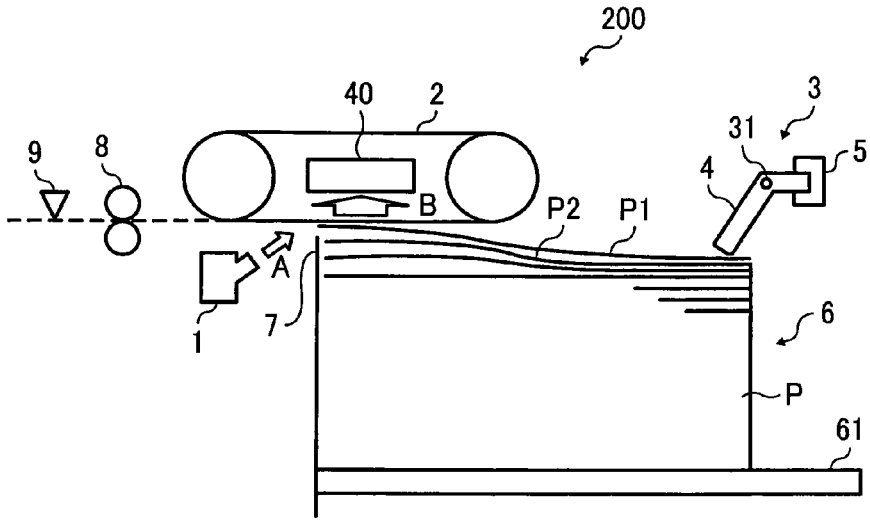
RELATED ART FIG. 17
FIG. 17 is a diagram explaining the state of starting the blowing of a blowing device and the suction of a suction device of the feeding device depicted in FIG. 16.
Figure 18:
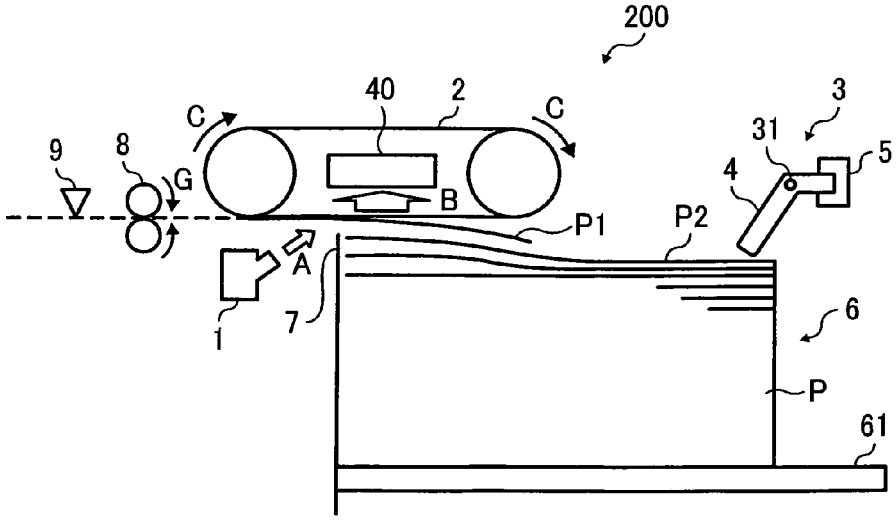
RELATED ART FIG. 18
FIG. 18 is a diagram explaining the state of starting the drive of a suction belt and a pair of carriage rollers from the state depicted in FIG. 17.
Figure 19:
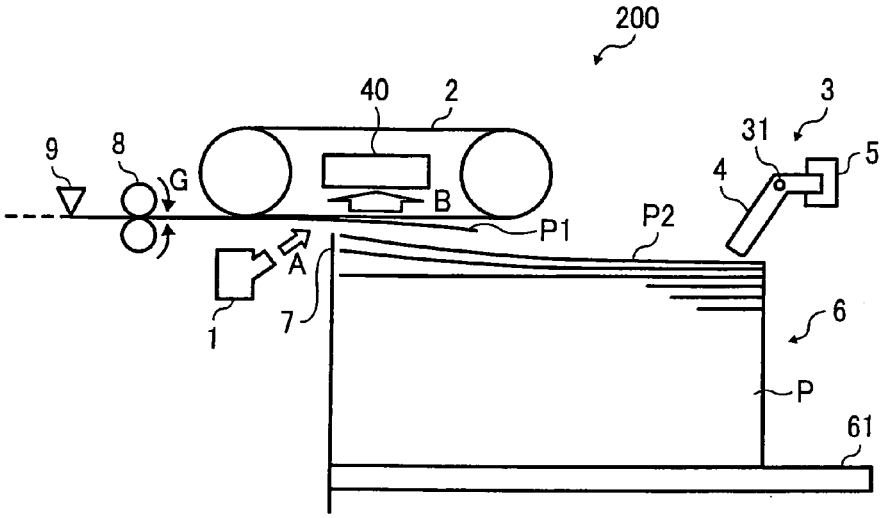
RELATED ART FIG. 19
FIG. 19 is a diagram explaining the state of stopping the drive of the suction belt from the state depicted in FIG. 18.
Figure 20:
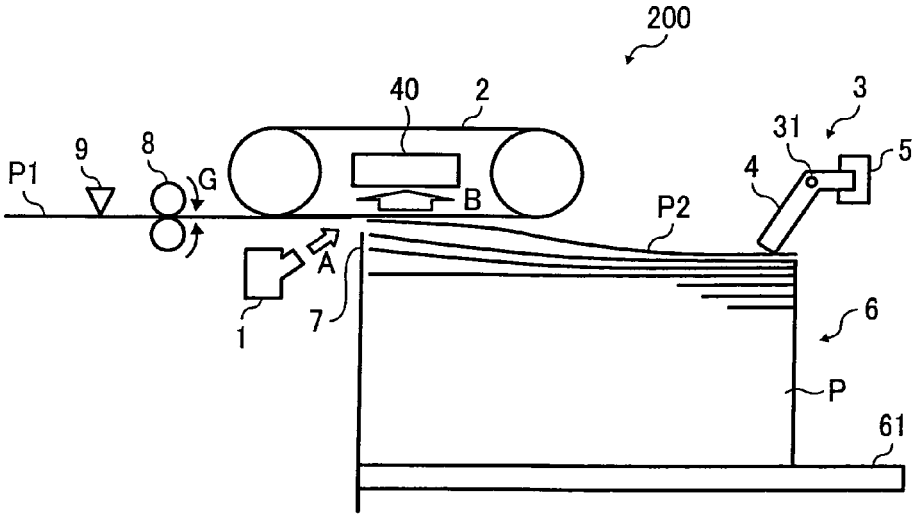
RELATED ART FIG. 20
FIG. 20 is a diagram explaining the state of the trailing edge of the sheet passing the suction area from the state depicted in FIG. 19.

FIG. 15 is a diagram explaining the paper P fed from the paper feed tray 6 (6*c* or 6*d*) of the second feeding device 200*b* (hereinafter, referred to as upstream side paper Pb) depicted in FIG. 1 passing above the first lower paper feed tray 6*b* of the first feeding device 200*a*.

As depicted in FIG. 15, the feeding device 200 is provided with the pair of upstream side paper carriage rollers 210 that conveys the upstream side paper Pb fed from the another feeding device 200 disposed on the upstream side to the gap between the topmost paper P1 placed in the paper feed tray 6 and the suction belt 2. The pair of upstream side paper carriage rollers 210 forms an upstream side paper feed path 14 that is the feed path for the upstream side paper Pb in the feeding device 200.

When feeding the upstream side paper Pb to the copying machine 100, the blowing device 1 is stopped, while the driving sources of the suction device 40, the belt driving motor 26, and the pair of carriage rollers 8, and the driving source of the pair of upstream side paper carriage rollers 210 are operated.

In the feeding device 200, the paper P is lifted by the blowing of the blowing device 1 and is sucked by a negative pressure generated by the suction device 40. Accordingly, by stopping the blowing device 1, the topmost paper P1 is not lifted with only the negative pressure of the suction device 40 and, in the same manner as when the feeding of the paper P stacked in the paper feed tray 6 is not performed, the gap is formed between the top surface of the topmost paper P1 and the suction belt 2. Operating the pair of upstream side paper carriage rollers 210 and the suction device 40 causes the upstream side paper Pb fed from the second feeding device 200*b* and conveyed by the pair of upstream side paper carriage rollers 210 to the gap between the top surface of the topmost paper P1 and the suction belt 2 to be attracted on the suction belt 2. Further, by operating the belt driving motor 26, the upstream side paper Pb attracted on the suction belt 2 can be conveyed towards the copying machine 100 by the endless movement of the suction belt 2.

In the feeding device 200 thus structured, the feed path of the upstream side paper Pb after being attracted on the suction belt 2 is the same feed path as when the paper P stacked in the first lower paper feed tray 6*b* in the first feeding device 200*a* is fed. More specifically, the suction belt 2 and the pair of carriage rollers 8 form a part of the feed path for the upstream side paper Pb, and the upstream side paper Pb supplied from the paper feed tray 6 (6*c* or 6*d*) of the second feeding device 200*b* can be fed to the copying machine 100.

Figure 21:
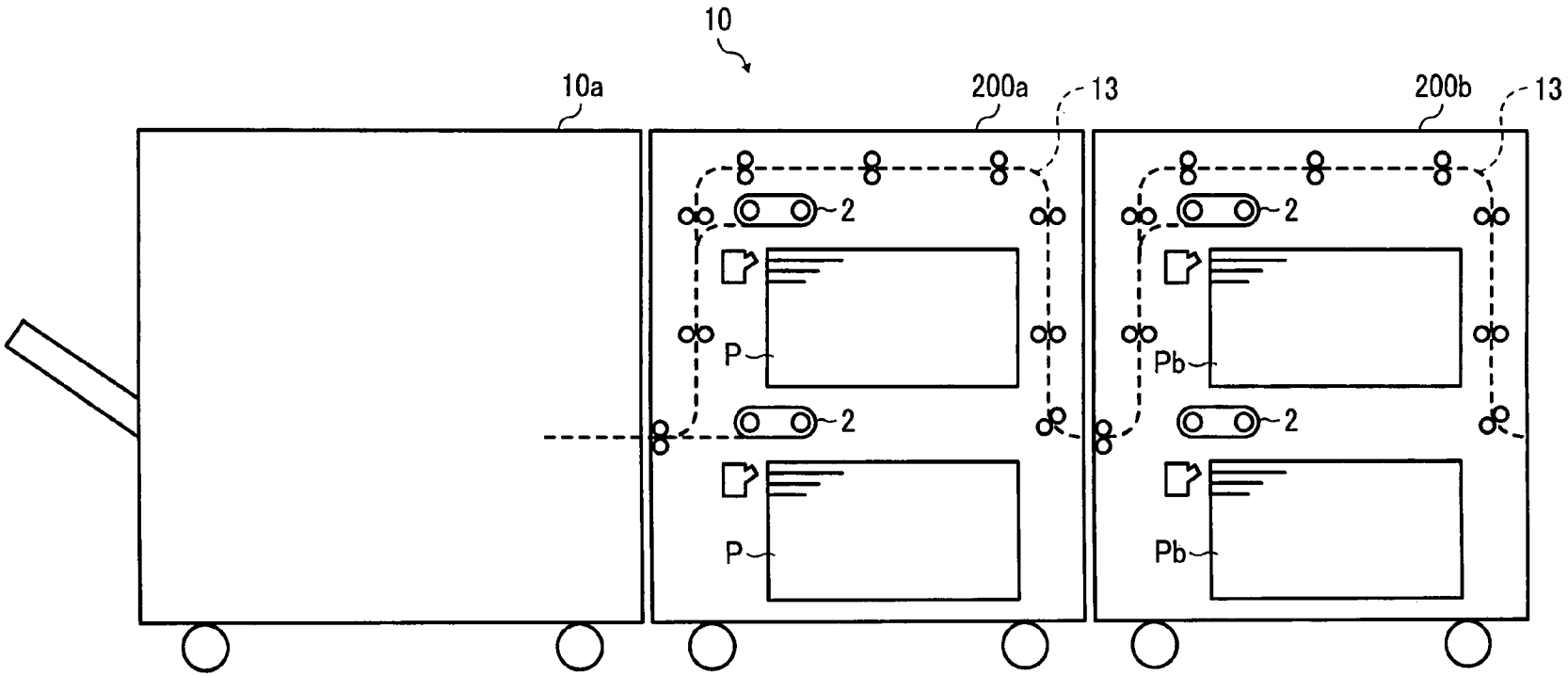
RELATED ART FIG. 21
FIG. 21 is a diagram explaining an image forming apparatus having a feeding device provided with a dedicated feed path for the sheet fed from other feeding device.

Thus, a dedicated feed path for the sheet fed from the second feeding device 200*b* (the dedicated external device sheet feed path 13 of the feeding device 200 depicted in FIG. 21) is not required. Consequently, although it is structured to be connectable with a plurality of feeding devices 200, an increase in the number of components for providing the dedicated feed path for the paper P fed from the other feeding devices 200 and an increase in space for the dedicated feed path can be prevented.

In the structure connecting the feeding devices of the frictional separation type as disclosed in Japanese Patent Application Laid-open No. 2009-57155, a conveying member disposed above the paper feed tray such as a pick-up roller is a conveying member of an abutment type that provides a force to go forward abutting on the topmost surface of the sheets placed in the paper feed tray. The conveying member of the abutment type can provide the force to go forward by the friction because it is indeed abutted on the topmost surface of the sheet placed in the paper feed tray with a certain amount of abutting pressure. Therefore, the force to go forward cannot be provided unless the sheet that is a conveying subject is sandwiched between the conveying member and other member (second and subsequent sheets placed on the bottom plate).

With such a structure, because the space cannot be formed between the sheets placed in the paper feed tray and the conveying member, the conveying member disposed above the paper feed tray cannot be used as a conveying member to convey the sheet supplied from the feeding device connected on the upstream side.

In contrast, as the feeding device 200 of the present embodiment, in the structure that conveys using the suction device 40 and the suction belt 2, the sheet is conveyed while the sheet is attracted on the suction belt 2 by the suction. Therefore, the force to go forward can be provided by the conveying member (suction belt 2) even when no other member is present below the rear surface of the sheet that is a conveying subject. Consequently, the suction belt that is a conveying member disposed above the paper feed tray can be used as the conveying member to convey the sheet supplied from the feeding device connected on the upstream side.

In the feeding device 200, the photo sensor 5 and the support shaft 31 are disposed above the upstream side paper feed path 14 and, when detecting the height of the top surface of the topmost paper P1, the actuator 4 crosses the upstream side paper feed path 14. However, when conveying the upstream side paper Pb, as depicted in FIG. 15, the position of the actuator 4 is set to the up (sheet height non-detecting state) position so that the conveyance of the upstream side paper Pb is not obstructed by the actuator 4.

In the feeding device 200, when conveying the upstream side paper Pb, the blowing device 1 is stopped so that the conveyance of the upstream side paper Pb is not obstructed by the paper P in the paper feed tray 6. As the structure not obstructing the conveyance of the upstream side paper Pb by the paper P, a structure may be adopted that performs control to widen the gap between the top surface of the topmost paper P1 and the bottom surface of the suction belt 2 by lowering the bottom plate 61 of the paper feed tray 6, instead of the structure that stops the blowing device 1.

The image forming apparatus 10 according to the present embodiment is provided with the feeding device 200 that can prevent an increase in the number of components for connection and an increase in space for the dedicated feed path, whereby an affordable and space saving image forming apparatus that is connectable to the feeding devices can be provided to the user.

The feeding device 200 of the image forming apparatus 10 according to the present embodiment is a multi-stage feeding device composed of the upper paper feed trays 6 (6*a* and 6*c*) and the lower paper feed trays 6 (6*b* and 6*d*). However, the features of the present embodiment can be applied to a combination of single stage paper feed trays (a combination of only the lower paper feed trays 6 (6*b* and 6*d*) in FIG. 1).

As described in the foregoing, the feeding device 200 according to the present embodiment is provided with the paper feed tray 6, the paper feed unit 22, and the blowing device 1. The paper feed tray 6 is a sheet housing unit, the paper feed unit 22 is a sheet conveying unit, and the blowing device 1 is an air discharging unit. In the paper feed tray 6, a plurality of sheets of the paper P can be placed, which are nearly horizontal. The paper feed unit 22 is provided with the suction belt 2 that is an endless belt member and the suction device 40 that is a suction unit disposed inside the suction belt 2. The suction belt 2 is disposed so as to face the top surface of the topmost paper P1 that is the topmost sheet positioned at the top of the paper P stacked in the paper feed tray 6 and to have a gap from the top surface of the topmost paper P1 when the feeding of the paper P stacked in the paper feed tray 6 is not performed. In the paper feed unit 22, the suction device 40 generates a negative pressure to attract the topmost paper P1 on the suction belt 2 below its outer surface and the suction belt 2 moves endlessly. Thus, the topmost paper P1 is attracted on the suction belt 2 to be conveyed towards the copying machine 100 that is in a subsequent step. The blowing device 1 blows air towards near the leading edge portion of the topmost paper P1 to lift the topmost paper P1 to the position where the topmost paper P1 can be attracted on the surface of the suction belt 2 by the negative pressure generated by the suction device 40. The first feeding device 200*a* that is a feeding device is connectable to the second feeding device 200*b* that is the other feeding device housing the upstream side paper Pb of sheets and is capable of feeding the upstream side paper Pb fed from the second feeding device 200*b* to the copying machine 100. The feeding device 200 is provided with the pair of upstream side paper carriage rollers 210 that is an external device sheet conveying unit conveying the upstream side paper Pb to the gap between the topmost paper P1 in the paper feed tray 6 and the belt member. When feeding the upstream side paper Pb to the copying machine 100, the blowing device 1 is stopped while the suction device 40, the suction belt 2, and the pair of upstream side paper carriage rollers 210 are operated. Stopping the blowing device 1 forms the gap between the top surface of the topmost paper P1 and the suction belt 2 as in the same state as when the feeding of the paper P stacked in the paper feed tray 6 is not performed. Meanwhile, operating the pair of upstream side paper carriage rollers 210 and the suction device 40 allows the upstream side paper Pb fed from the second feeding device 200*b* and conveyed by the pair of upstream side paper carriage rollers 210 to the gap between the top surface of the topmost paper P1 and the suction belt 2 to be attracted on the suction belt 2. Further, operating the suction belt 2 enables the upstream side paper Pb attracted on the suction belt 2 to be conveyed towards the copying machine 100 that is in the subsequent step by the endless movement of the suction belt 2.

In the feeding device 200 thus structured, the feed path of the upstream side paper Pb after being attracted on the suction belt 2 is the same as the feed path of when feeding the paper P stacked in the paper feed tray 6. In other words, the suction belt 2 forms a part of the feed path of the upstream side paper Pb. As a consequence, it is not necessary to provide a dedicated feed path for the sheet fed from the second feeding device 200*b*, thereby preventing an increase in the number of components for providing the dedicated feed path and an increase in space for the dedicated feed path. Because the increase in the number of components for conveying the upstream side paper Pb and the increase in space for the dedicated feed path can be prevented, the first feeding device 200*a* can be connected to the second feeding device 200*b* on the upstream side while preventing the manufacturing cost and device space from increasing.

The blowing device 1 blows air towards the leading edge portion of the paper P near the topmost paper P1 of the paper P stacked in the paper feed tray 6. The blowing device 1 is also an air discharging unit that blows air to lift the leading edge portions of the topmost paper P1 and other paper P near the topmost paper P1 and to separate sheets of the paper P one from the other. With such a structure, the feeding device 200 separates the paper P by blowing air and sucks the topmost paper P1 onto the suction belt 2 to separate and convey the paper P. Because the suction belt 2 is only to convey the paper P in the state being separated by the blowing of air and suction, compared with the feeding device of the frictional separation type that frictionally separates sheets, the feeding device 200 of the present embodiment can deal with high linear speed and high productivity.

The feeding device 200 further has the sheet top sensor 3 that is a sheet top position detecting unit detecting the height of the top surface of the topmost paper P1 in the paper feed tray 6, and the bottom plate 61 that supports the bottom surface of the paper P stacked in the paper feed tray 6. Moreover, the feeding device 200 is provided with the elevating mechanism not depicted that is an elevating unit elevating the bottom plate 61 in the vertical direction by driving the bottom plate elevating motor M1 that is a driving source, and an elevation control device not depicted that is an elevation control unit controlling the operation of the elevating mechanism by controlling the drive of the bottom plate elevating motor M1. The elevation control device not depicted controls the drive of the bottom plate elevating motor M1 based on the detection result of the sheet top sensor 3 such that the height of the top surface of the topmost paper P1 of the paper P on the bottom plate 61 comes to a given height. The sheet top sensor 3 is provided with the actuator 4, the photo sensor 5 that detects the position of the actuator, and the position switching mechanism. The actuator 4 is a top surface contacting member that is brought into contact with the top surface of the topmost paper P1 and swings up and down to change its position in response to the changes in the height of the top surface. The photo sensor 5 is a top surface height detecting sensor that detects the changes in the height of the top surface of the topmost paper P1 by detecting the changes in the position of the actuator 4. The position switching mechanism is a contacting member position control unit that is structured with the actuator spring 33, the pressure arm 35, and the pressure motor 34 and can control the position of the actuator 4 regardless of the height of the top surface of the topmost paper P1. A control unit not depicted controls the drive of the pressure motor 34 to control the operation of the position switching mechanism to switch the position of the actuator 4 between the down (sheet height detecting state) position and the up (sheet height non-detecting state) position.

The photo sensor 5 is disposed above the upstream side paper feed path 14 that is an external sheet feed path along which the upstream side paper Pb conveyed towards the gap between the topmost paper P1 and the suction belt 2 by the pair of upstream side paper carriage rollers 210 passes. When feeding the upstream side paper Pb to the copying machine 100, the position switching mechanism controls to position the actuator 4 at the up (sheet height non-detecting state) position so that the lower end portion of the actuator 4 comes above the upstream side paper feed path 14. Accordingly, the upstream side paper Pb can be conveyed without being obstructed by the actuator 4.

The image forming apparatus 10 according to the present embodiment is provided with the copying machine 100 provided with the image forming section 101 that forms an image on the paper P as a sheet of a recording medium, and the feeding device 200 that is a paper feeding unit feeding the paper P to the copying machine 100. By using the feeding device 200 as the paper feeding unit, an affordable and space saving image forming apparatus that is connectable to the feeding devices 200 can be provided to the user.

In the feeding device according to the present invention, when the sheet supplied from the other feeding device is fed to the subsequent step, the elevating unit is being stopped while the suction unit, the belt member, and the external device sheet conveying unit are in operation. Stopping the elevating unit results in a gap formed between the top surface of the topmost sheet and the belt member in the same manner as when the feeding of the sheets stacked in the sheet housing unit is not performed. Operating the external device sheet conveying unit and the suction unit allows the sheet fed from the other feeding device and conveyed by the external device sheet conveying unit to the gap between the top surface of the topmost sheet and the belt member to be attracted on the belt member. Furthermore, operating the belt member allows the sheet fed from the other feeding device and attracted on the belt member to be conveyed towards the subsequent step by the endless movement of the belt member.

In the feeding device thus structured, the feed path of the sheet after being attracted on the belt member is the same feed path as when the sheets stacked in the sheet housing unit are fed. Consequently, a dedicated feed path for sheets fed from the other feeding device is not required, whereby an increase in the number of components for providing the dedicated feed path and an increase in space for the dedicated feed path can be prevented.

According to the present invention, an increase in the number of components for conveying sheets fed from the other feeding device and an increase in space for the dedicated feed path can be prevented, while the structure is connectable to the other feeding device on the upstream side. The present invention thus has a superior effect of preventing increases in manufacturing cost and in device space.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device configured to be connected to another feeding device and receive a sheet from the other feeding device, the feeding device comprising:

a sheet housing unit configured to house therein a plurality of sheets stacked;

a sheet conveying unit configured to convey either a topmost sheet positioned at top of the sheets stacked from the sheet housing unit or a sheet fed from the other feeding device;

an air discharging unit configured to blow air toward the sheets stacked in the sheet housing unit so as to move the topmost sheet up toward the sheet conveying unit; and a control unit configured to cause the air discharging unit to blow air when the sheet conveying unit conveys the topmost sheet from the sheet housing unit, and further configured to cause the air discharging unit to stop blowing air when the sheet conveying unit conveys the sheet fed from the other feeding device.

2. The feeding device according to claim 1, wherein the sheet conveying unit includes an endless belt member configured to face a top surface of the topmost sheet of the sheets stacked in the sheet housing unit; and a suction unit that is inside the belt member, wherein the sheet conveying unit attracts the topmost sheet or the sheet fed from the other feeding device on an outer surface of the belt member by generating a negative pressure in the suction unit and conveys the attracted sheet towards a subsequent step by endlessly moving the belt member.

3. The feeding device according to claim 2, wherein when feeding of the sheets stacked in the sheet housing unit is not performed, a gap is formed between the belt member and the top surface of the topmost sheet.

4. The feeding device according to claim 2, further comprising a sheet lifting unit configured to lift the sheets stacked in the sheet housing unit, wherein when the sheet conveying unit conveys the topmost sheet from the sheet housing unit, the sheet lifting unit lifts the sheets stacked to a position where the topmost sheet is attracted on the surface of the belt member by the negative pressure generated by the suction unit.

5. The feeding device according to claim 4, wherein when the sheet conveying unit conveys the sheet fed from the other feeding device, the sheet lifting unit is stopped at a position that increases the gap between the topmost sheet and a surface of the belt member while the suction unit and the belt member are operated.

6. The feeding device according to claim 2, the feeding device further comprising an external device sheet conveying unit configured to convey the sheet fed from the other feeding device to a gap between the topmost sheet in the sheet housing unit and the belt member.

7. A feeding device configured to be connected to another feeding device and receive a sheet from the other feeding device, the feeding device comprising:

a sheet housing unit configured to house therein a plurality of sheets stacked;

a sheet conveying unit configured to convey either a topmost sheet positioned at top of the sheets stacked from the sheet housing unit or a sheet fed from the other feeding device;

a sheet top position detecting unit including a contacting member that contacts to the top surface of the topmost sheet to detect a vertical position of the topmost sheet, the contacting member being configured to move between a detecting position where the contacting member is in a contacting position of contacting the topmost sheet and a non-detecting position where the contacting member is away from the contacting position; and a control unit configured to control a position of the sheet top position detecting unit from detecting position to the non-detecting position so that the contacting member comes above the sheet fed from the other feeding device when the feeding device receives the sheet fed from the other feeding device.

8. An image forming apparatus comprising:

an image forming section that forms an image on an image forming sheet of a recording medium; and a paper feeding unit that feeds the image forming sheet to the image forming section, the paper feeding unit configured to be connected to another feeding device, the paper feeding unit comprising:

a sheet housing unit configured to house therein a plurality of sheets stacked;

a sheet conveying unit configured to convey either a topmost sheet positioned at top of the sheets stacked from the sheet housing unit or a sheet fed from the other feeding device as the image forming sheet;

an air discharging unit configured to blow air toward the sheets stacked in the sheet housing unit so as to move the topmost sheet up toward the sheet conveying unit; and a control unit configured to cause the air discharging unit to blow air when the sheet conveying unit conveys the topmost sheet from the sheet housing unit, and further configured to cause the air discharging unit to stop blowing air when the sheet conveying unit conveys the sheet fed from the other feeding device.

9. The image forming apparatus according to claim 8, wherein the sheet conveying unit includes an endless belt member configured to face a top surface of the topmost sheet of the sheets stacked in the sheet housing unit; and a suction unit that is inside the belt member, wherein the sheet conveying unit attracts the topmost sheet or the sheet fed from the other feeding device on an outer surface of the belt member by generating a negative pressure in the suction unit and conveys the attracted sheet towards a subsequent step by endlessly moving the belt member.

10. The image forming apparatus according to claim 9, wherein when feeding of the sheets stacked in the sheet housing unit is not performed, a gap is formed between the belt member and the top surface of the topmost sheet.

11. The image forming apparatus according to claim 9, wherein the feeding device further comprises a sheet lifting unit configured to lift the sheets stacked in the sheet housing unit, and when the sheet conveying unit conveys the topmost sheet from the sheet housing unit, the sheet lifting unit lifts the sheets stacked to a position where the topmost sheet is attracted on the surface of the belt member by the negative pressure generated by the suction unit.

12. The image forming apparatus according to claim 11, wherein when the sheet conveying unit conveys the sheet fed from the other feeding device, the sheet lifting unit is stopped at a position that increases the gap between the topmost sheet and a surface of the belt member while the suction unit and the belt member are operated.

13. The image forming apparatus according to claim 9, wherein the feeding device further comprises an external device sheet conveying unit configured to convey the sheet fed from the other feeding device to a gap between the topmost sheet in the sheet housing unit and the belt member.

* * * * *